US005836059A

United States Patent [19]

Chung

[11] Patent Number: 5,836,059

[45] Date of Patent: Nov. 17, 1998

[54] INVISIBLE ZIPPER WITH OPEN-END

[75] Inventor: Roger C. Y. Chung, Hsin-Chuan, Taiwan

[73] Assignee: Keen Ching Industrial Co., Ltd., Taipei Hsien, Taiwan

[21] Appl. No.: 895,037

[22] Filed: Jul. 16, 1997

[51] Int. Cl.[6] ..... A44B 19/00

[52] U.S. Cl. ..... 24/432; 24/388; 24/433

[58] Field of Search ..... 24/432, 433, 431, 24/388

[56] References Cited

U.S. PATENT DOCUMENTS

| | | | |
|---|---|---|---|
| 1,949,882 | 3/1934 | Rocke | 24/433 |
| 2,093,973 | 9/1937 | Clark | 24/433 |
| 2,997,766 | 8/1961 | McNamara | 24/432 |
| 5,388,312 | 2/1995 | Fudaki | 24/433 |

FOREIGN PATENT DOCUMENTS

| | | | |
|---|---|---|---|
| 0869740 | 2/1942 | France | 24/433 |
| 0891665 | 3/1962 | United Kingdom | 24/432 |

*Primary Examiner*—Victor N. Sakran
*Attorney, Agent, or Firm*—Bacon & Thomas

[57] ABSTRACT

The structural design of an invisible zipper with an open-end, particularly indicating an innovation which employs to modify the conventional invisible zipper with closed-end into an invisible zipper with open-end, mainly consists of an open-ended chain tape, a resilient tape hook, an inserting pin and a rectangular box; The ends of the left and right open-end chain tapes are formed into rubberized fabric portions by thermal melting rubber; an inserting pin and a resilient tape hook, which are made by plastic injection molding or punching, are fixed to the left and right rubberized fabric portions of the chain tape, and after the separating chain tapes are sewed to the clothes, and the resilient tape hook set up at one of the chain tapes is forced to wedge into a rectangular box, one can make use of this kind of design to fabricate an invisible zipper with open-end.

1 Claim, 3 Drawing Sheets

INVISIBLE ZIPPER WITH OPEN-END

BACKGROUND OF THE INVENTION (a). Field of Invention

The present invention relates to an invisible zipper with open-end and more particularly to an innovation which employs to modify the conventional invisible zipper with closed-end into an invisible zipper with open-end.

(b). Description of the Prior Art

Normally, the main components of a zipper are chain teeth and adapter which are fixed to the chain tape. The conventional chain teeth are made of metal but the common chain teeth nowaday are otherwise made of plastic and are integrally formed ( nylon zipper for example); besides, there are two kinds of zippers, one with closed-end and the other with open-end. The-closed-end zippers are generally used in such clothing as trousers, pullover or western-style clothes. The open-end zippers are mostly applied in overcoats and jackets etc., when it is in use, the inserting pin at the end of one of the two separating chain tapes is first inserted directly into the rectangular box which is provided at the end of the other chain tape, then, a slide with a pull-head is pulled upward to fasten the two chain tapes by engaging the two chains of teeth together. Moreover, the open-end zipper as mentioned above mostly has the provision of a cloth-cover to avoid the chain teeth of the zipper being exposed to the outside in order to keep pleasant to the eyes. Furthermore, what is shown in FIG. 1 is a kind of invisible zipper. An invisible zipper is generally applied in a zipper with closed-end, since one side of the invisible zipper exposes the chain teeth while the other side shows intact plane without any teeth being exposed, thereby, with the side having chain teeth facing inward, the chain tape is sewed together with the folded edge of the clothes along the folded edge of the chain teeth because the sewing feet are bestridding over the chain tape to carry out the sewing operation. Therefore, if the provision of rectangular box at the end of a common zipper with open-end is applied in an invisible zipper, the fact that it still can not carry out the sewing operation through the sewing feet will result in the inability of the invisible zipper at present to be practically applied in the invisible zipper with open-end. It is a pity as this is beautiful yet insufficient.

SUMMARY OF THE INVENTION

The primary objective of the present invention is to provide the design of an invisible zipper with open-end which mainly comprises an open-end chain tape, a resilient tape hook, an inserting pin and a rectangular box where the chain tape consists of a left and a right chain tapes with their ends formed rubberized fabric portions by thermal melting rubber to reinforced the strength of the end portions. Moreover, an inserting pin and a resilient tape hook, which are made by plastic injection molding or punching, are fixed to the left and right rubberized fabric portions of the chain tape, and after the separating chain tapes are sewed to the clothing by making use of the sewing feet and the resilient tape hook set up at one of the chain tapes is forced to wedge into a rectangular box, one can make use of this kind of design to fabricate an invisible zipper with open-end In order to make your honor examiners understand the present invention in more detail, the authors herewith present an embodiment with the accompanied drawings as shown in the followings:

DETAILED DESCRIPTION OF THE PREFERRED EMBODIMENTS

Figure 1:
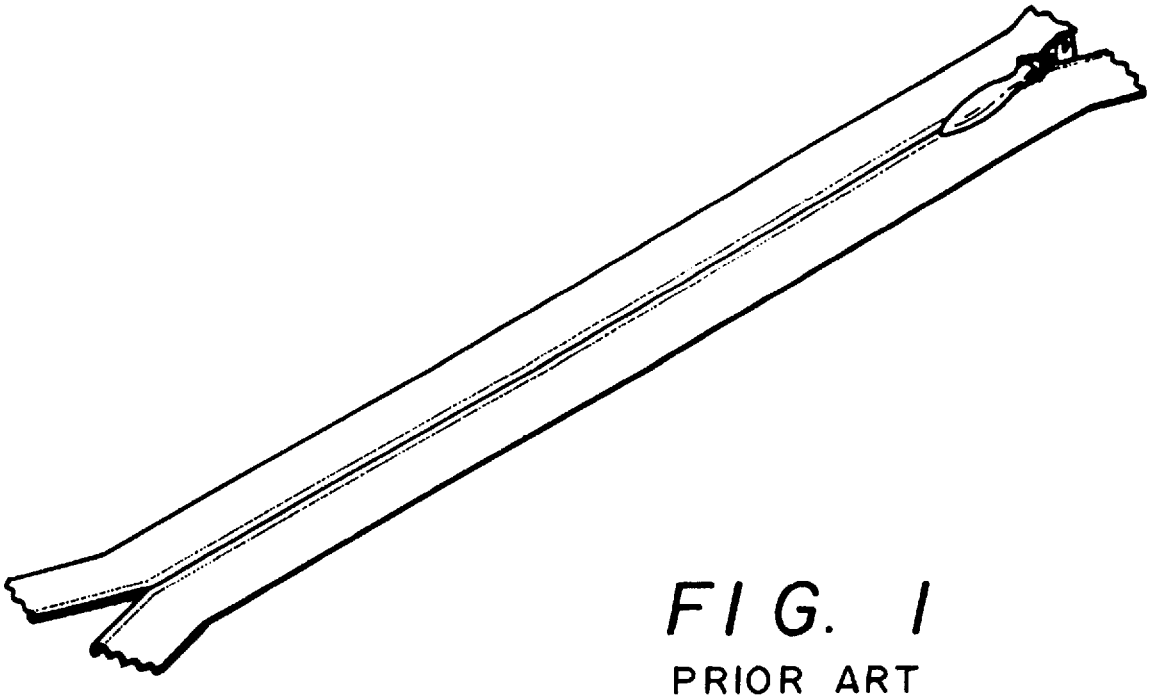
FIG. 1 PRIOR ART
FIG. 1 is the isometric assembled drawing of the prior art.
Figure 2:
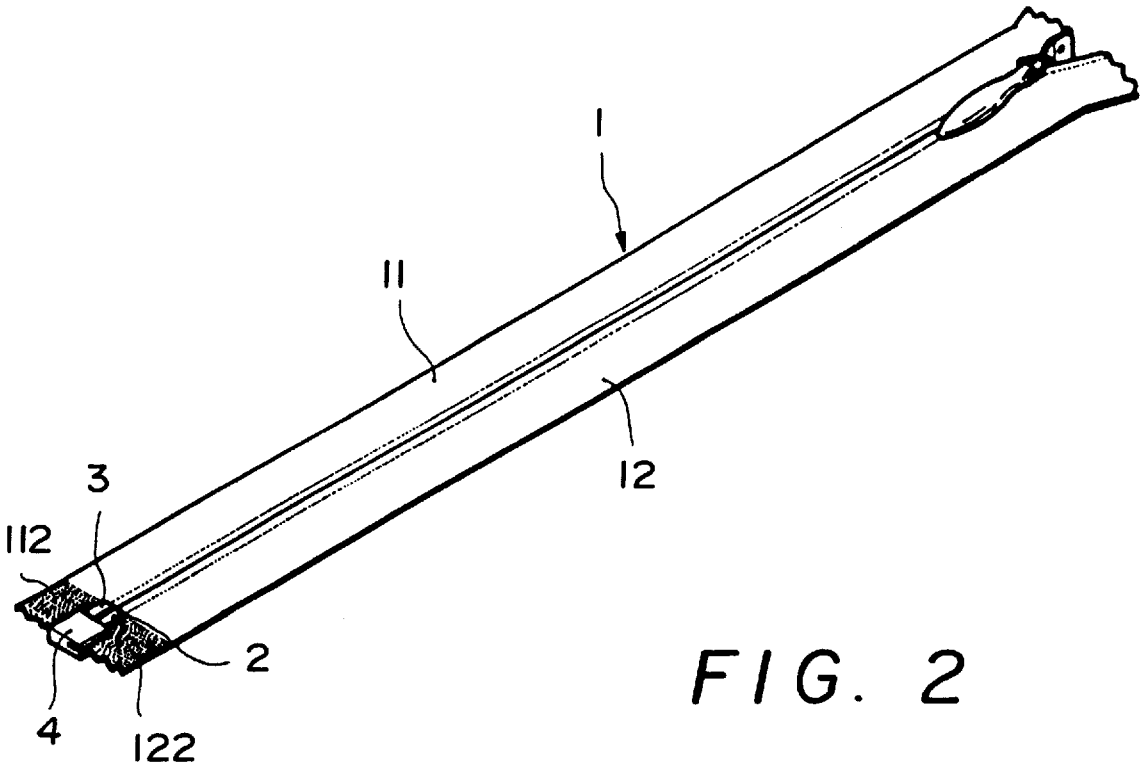
FIG. 2 is the isometric assembled drawing of the present invention.
Figure 3:
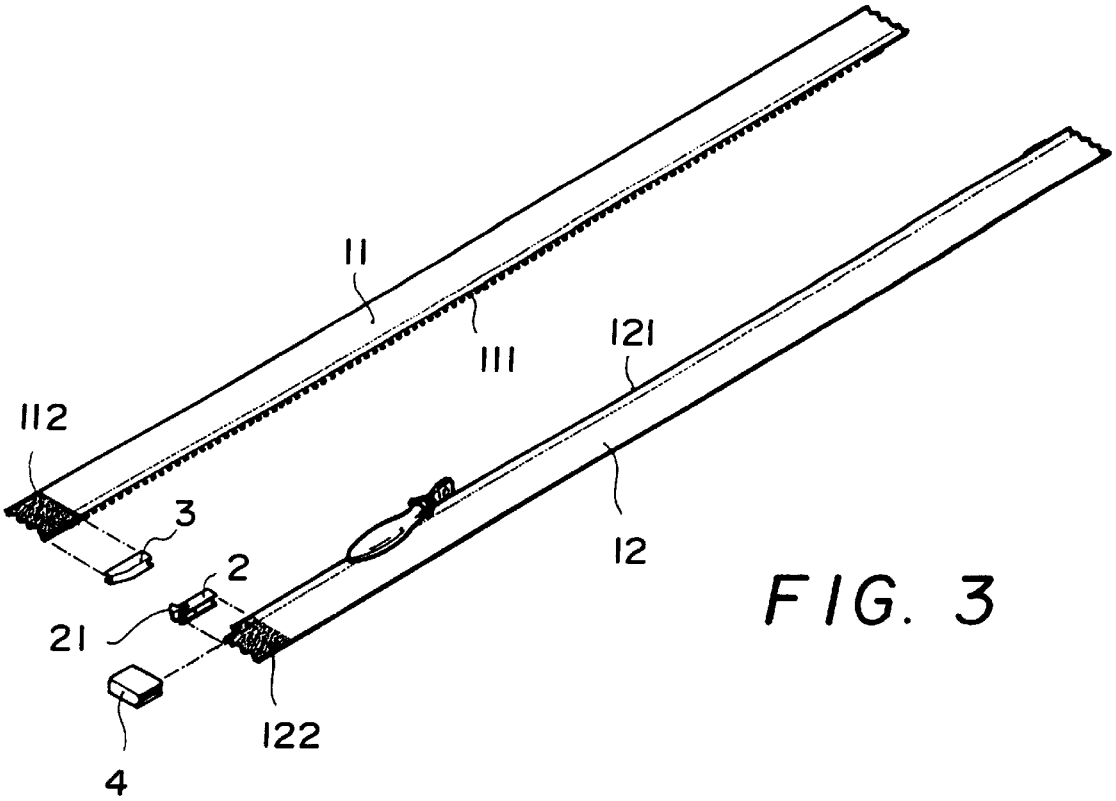
FIG. 3 is the isometric disassembled drawing of the present invention.
Figure 4:
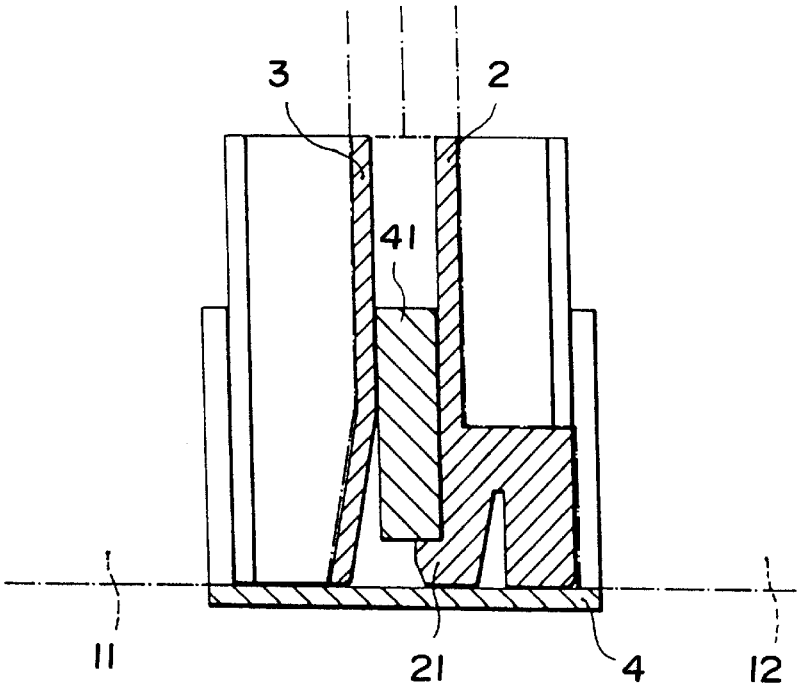
FIG. 4 is the cross-sectional drawing of the combination of the resilient tape hook, the inserting pin and the rectangular box of the present invention.
Figure 5:
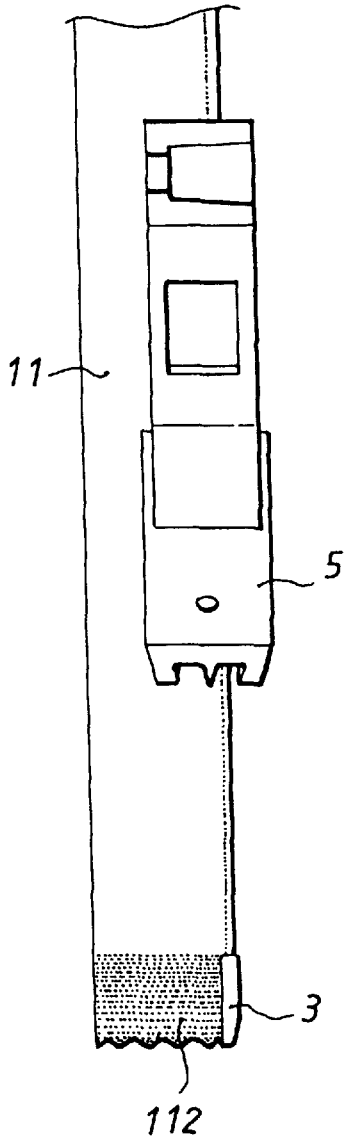
FIG. 5 is the schematic diagram of the present invention showing the sewing feet can pass the inserting pin during the sewing process.
Figure 6:
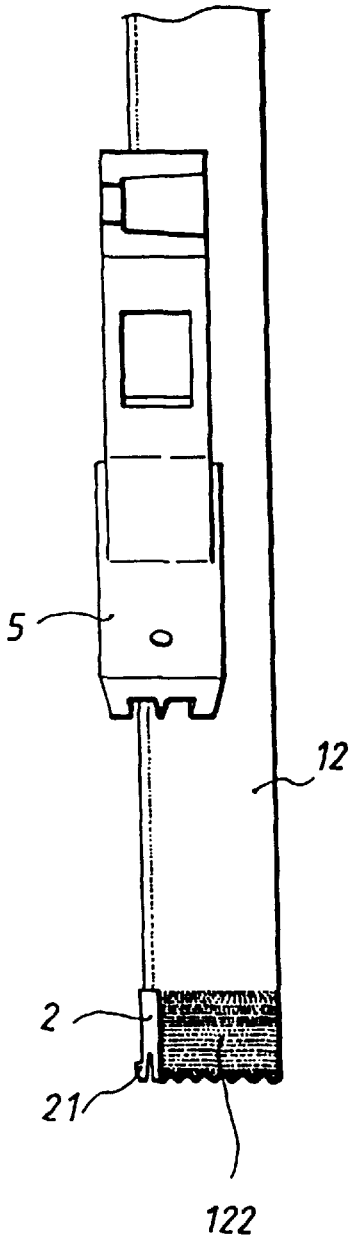
FIG. 6 is the schematic diagram of the present invention showing the sewing feet can pass the resilient tape hook during the sewing process.

As shown in FIG. 3 and FIG. 4, the structural design of an invisible zipper with open-end mainly consists of an open-ended chain tape 1, a resilient tape hook 2, a pin 3 and a box 4 wherein:

The chain tape 1 includes a left and a right chain tapes 11,12 which are provided with chain teeth 111 and 121 respectively. One side of the chain tape exposes the chain teeth 111 and 121 while the other side does not but shows intact plane. The ends of the chain tape 11 and 12 are formed into rubberized fabric portions 112 and 122 respectively by thermal melting rubber;

Resilient tape hook 2, which is made by plastic injection molding or punching, is provided to fix to the rubberized fabric portion 122 ( in this case) set up at either the right chain tape 12 (in this case) or the left chain tape 11, and an inverted hook 21 is provided at one side of the end of the resilient tape hook 2;

Inserting pin 3, which is equivalent to that of the prior art and which is made by plastic injection molding or punching, is provided to fix to the rubberized fabric portion 112 (in this case) set up at either the left chain tape 11 (in this case) or the right chain tape 12;

Rectangular box 4, which shows a rectangular body with an appropriate dimension, has a setup of a partition wall 41 at an appropriate location on the interior wall to form a left and a right-hand side space with one side space providing the resilient tape hook 2 to be forced to wedge into and having the inverted hook portion 21 of the resilient tape hook 2 popped in and hooked to the bottom of the partition wall 41 to be in position while the other side space providing the inserting pin 3 to insert into;

By the use of the foregong components, one can combines the rubberized fabric portions 112 and 122 of the ends of the left chain tape 11 and right chain tape 12 of the chain tape 1 with an inserting pin 3 and a resilient tape hook 2 which are made by plastic injection molding or punching; moreover, by means of the sewing feet 5 of a sewing machine, one can sew the edges of the chain teeth 111 and 121 of the left chain tape 11 and right chain tapel2 respectively to the clothing, then, the resilient tape hook 2 set up at the right chain tape 12 is to be forced to wedge into the rectangular box 4; such arrangement can fabricate an invisible zipper with open-end.

To summarize the above-mentioned statements, the present invention provide an invisible zipper where the inserting pin and the resilient tape hook can be passed by the sewing feet of the sewing machine during the sewing operation which practically facilitate the application of an invisible zipper in the one with open-end. Therefore, it is really practical and progressive with commercial value that can be provided for the industrial application., besides, it is not found in any publications, therefore, it meets the requirements of patentability and is in accordance with the Patents Act.

Although the present invention has been illustrated and described previously with reference to the preferred embodiments thereof, it should be appreciated that it is in no way limited to the details of such embodiments, but is capable of numerous modification within the scope of the appended claims.

I claim:

1. An open end invisible zipper comprising:

a) first and second chain tapes each having chain teeth engageable with chain teeth of the other chain tape and a rubberized fabric end portion;

b) a tape hook member fixedly attached to the rubberized fabric end portion of the first chain tape, the tape hook member having an end and a side portion, a notch extending inwardly from the end and a hook extending outwardly from the side portion whereby the notch enables resilient displacement of the hook relative to the tape hook member;

c) an inserting pin fixedly attached to the rubberized fabric end portion of the second chain tape; and, d) a box having a hollow rectangular configuration with an end wall and a partition wall within the hollow box spaced from the end wall whereby insertion of the tape hook member into the box on a first side of the partition wall causes the hook to engage the partition wall such that the end of the tape hook member is in contact with the end wall of the box to immovably attach the box to the first chain tape.

* * * * *